United States Patent [19]

Petersen, Jr. et al.

[11] Patent Number: 4,747,247

[45] Date of Patent: May 31, 1988

[54] ROOF SYSTEM

[75] Inventors: Wayne E. Petersen, Jr., Granville; Gordon P. Petrash, Newark; David L. Roodvoets, Westerville; Elizabeth A. Riley, Newark, all of Ohio

[73] Assignee: The Dow Chemical Company, Midland, Mich.

[21] Appl. No.: 909,352

[22] Filed: Sep. 19, 1986

[51] Int. Cl.[4] ..... C04B 5/00

[52] U.S. Cl. ..... 52/408; 52/404

[58] Field of Search ..... 52/404, 408

[56] References Cited

U.S. PATENT DOCUMENTS

| | | | |
|---|---|---|---|
| 2,106,390 | 1/1938 | Crane | 52/404 |
| 2,616,283 | 11/1952 | Branstrator et al. | 52/408 |
| 3,466,222 | 9/1969 | Curtis | 52/309.8 X |
| 3,763,605 | 10/1973 | Freeman | 52/408 X |
| 3,763,614 | 10/1973 | Hyde et al. | 52/408 X |
| 3,971,184 | 7/1976 | Van Wagoner | 52/408 X |
| 4,073,997 | 2/1978 | Richards et al. | 52/309.4 X |
| 4,449,336 | 5/1984 | Kelly | 52/408 X |

*Primary Examiner*—William F. Pate, III
*Assistant Examiner*—Creighton Smith

[57] ABSTRACT

Disclosed is a roof structure containing a fire retardant. The roof structure has a fluted deck with troughs therein and a meltable insulation layer overlying the fluted deck. The fire retardant includes a series of non-flammable absorbent strips or strip segments which can be placed in the troughs of the fluted deck for retarding the flow of molten insulation in the trough during a fire by absorbing the molten insulation material in the trough.

13 Claims, 2 Drawing Sheets

ROOF SYSTEM

BACKGROUND OF THE INVENTION

The present invention relates to roofing structures for buildings, and more particularly to fire retardants for roofing structures which utilize thermoplastic insulation.

Roofing structures for large commercial buildings typically utilize fluted metal decks of steel or aluminum. The metal decks are usually overlain with one or more layers of insulation, waterproofing material, and ballast material. Many types of insulation materials are used in roofing structures. One type of insulation material which is used widely is thermoplastic foam. Thermoplastic foam insulation materials are used widely because they are relatively light weight and have superior insulative properties.

One difficulty encountered with the use of thermoplastic foam insulation in roofing structures is that thermoplastic foams can melt and burn, thereby contributing to a fire. For example, molten plastic insulation can contribute to a fire by internally self-propagating the spread of fire in a roof deck. Internal self-propagation of fire is a condition wherein fire spreads inside the roofing assembly, after the roofing material is ignited by the heat from a fire within a building.

Standards for roof construction were established to prevent this type of fire after a fire occurred at a General Motors plant in Livonia, Michigan. This fire resulted in a $35,000,000 loss and the total collapse of the 30-acre structure. Due to the nature of the plant's roof construction, hot, combustible gases were unable to escape the roofing assembly and subsequently contributed to the fire directly below the roof structure.

As a result, building codes specify fire spread performance criteria for roofing structures. These criteria are determined by nationally recognized test standards for building assemblies. For example, some building codes require that a 15-minute fire or thermal barrier be incorporated in a roof assembly between foamed plastic insulation and occupied interiors unless the roof construction has passed a diversified test such as a test conducted by Underwriters Laboratories, Inc. The UL test utilizes a test structure on which a roof assembly is constructed which is 20 feet wide by 100 feet long and 10 feet high. A fire is started at one end of the structure to determine the burning characteristics of the test structure. The determination of whether the test structure passes the UL test is made by comparing the performance of the test structure to the performance of a "standard" roof structure utilizing a one-inch vegetable fiberboard insulation, which is mechanically affixed to the steel deck and overlain by a asphaltic, built up membrane. In order for the test structure to pass the test, underdeck flaming must not exceed 60 feet, with tips of the flaming not extending beyond 72 feet from the end of the structure at which the fire is started.

Various methods of roof construction have been proposed to reduce the likelihood that plastic foam insulation will contribute to a fire. For example, Hyde et al. U.S. Pat. No. 3,763,614: Curtis U.S. Pat. No. 3,466,222: and Kelly U.S. Pat. No. 4,449,336 are representative of one type of solution. Hyde, Curtis and Kelly attempt to solve the aforementioned problem by interposing a non-combustible material between a metal roof and a layer of thermoplastic foam.

In Hyde et al, a metal deck is overlain with a non-combustible insulating layer comprised of gypsum board, foamed glass, ceramic foam, or thermosetting plastic foam. A water impermeable layer overlays the non-combustible layer, and a thermal insulating layer overlays the water impermeable layer. A protective surface comprised of gravel or sand and cement is placed over the thermal insulating layer.

Curtis relates to a fire retardant structure utilizing an insulative laminate. Curtis laminate includes a lower foil layer, which is overlain by a lamina formed of at least 50% unexpanded vermiculite in a binder. A foam core is disposed above the lamina and an upper traffic and mopping surface overlays the plastic foam insulation layer.

Kelly relates to a roof structure wherein a metal deck is overlain by a fireproof member which is preferably made of plaster board. A reservoir board overlays the fireproof member and includes a plurality of apertures. The reservoir board is preferably formed of gypsum, fiberboard, or Perlite. A layer of insulation overlays the reservoir board. In a fire hot enough to melt the insulation layer, the molten insulation is captured in the apertures of the reservoir board.

Richards et al, U.S. Pat. No. 4,073,997, relates to another type of proposed solution of the aforementioned problem. Richards discloses a composite panel which includes an organic foam core which is sandwiched between two layers of inorganic fibers.

Although the systems proposed in the above-discussed patents do serve to reduce the flammability of thermoplastic insulation, the addition of a non-combustible layer between the deck and the insulation adds significantly to the cost of a roofing structure. This additional cost can place the use of plastic insulation at a cost disadvantage.

Another solution was proposed by the Working Group Concerned with Roofs in the West German Fire Protection Association in an article entitled "Fire Safety and Thermally Insulated Flat Roofs with Trapazoidal Steel Profiles—Parts I and II: Final Report". 1986 *Fire Safety Journal,* No. 10, pages 139–147 (originally published in the German language in VFDB-Zeitschrift 33 (2) (1984) 44–49 and 50–53). One of the solutions proposed in the Working Group report involves the placement of fire stops in the grooves of the metal deck. These fire stops are provided to block the flow of gases or liquids given off by the melting insulation into the building. Preferably, these fire stops should be non-combustible and should reliably block the cavities at temperatures of about 800° C. The materials used for forming the fire stops should also be sufficiently dense to prevent the passage of gaseous and liquid products of decomposition. The materials must also adequately withstand the mechanical loads acting on the roof under normal thermal and load conditions.

Although the Working Group report does disclose an alternative to the interposition of a non-combustible layer between a metal deck and a thermoplastic insulator layer, room for improvement exists.

SUMMARY OF THE INVENTION

In accordance with the present invention, a fire retardant is provided for a roof structure having a fluted deck and a meltable insulation layer overlying the fluted deck. The fire retardant comprises a non-flammable absorbent strip which can be placed in a trough of the fluted deck for retarding the flow of molten insulation in the trough during a fire by absorbing molten insulation material in the trough.

Also in accordance with the present invention, a fire retardant roof structure system is provided. The roof structure system comprises a deck member having an upper surface including at least one trough portion and at least two crest portions. A thermoplastic insulation member is disposed on the crest portions and spans the trough portion. A non-flammable absorbent strip is disposed in the trough portion for retarding the flow of molten insulation in the trough portion during a fire. A water impermeable membrane layer is disposed in an overlying relation to the thermoplastic insulation member, and ballast material is disposed in an overlying relation to the water impermeable membrane.

Preferably, the non-flammable absorbent strip is comprised of an inert absorbent, inorganic granular material such as sand, gypsum, fly ash, vermiculite, glass fibers (such as Fiberglas, trademark of Owens-Corning Fiberglas Corp., Toledo, Ohio), crushed glass, expandable shale, expandable clay, iron ore slag, firestop caulking, cement powder, crushed shells, pea gravel, epsom salts and crushed rocks.

The fire absorbent strips should have a cross-sectional area generally equal to the cross-sectional area of the troughs in which they are placed. The strips can either extend along the entire length of the trough, or can comprise a series of discrete absorbent strip segments, with each segment being between about 1 and 6 inches long and preferably between about 3 and 6 inches long.

One feature of the present invention is that an absorbent is placed between a layer of thermplastic insulation and a metal roof deck. In the case of a fire hot enough to cause the thermoplastic insulation to melt, the absorbent will absorb and dam the flow of molten thermoplastic in the trough of the metal deck. The absorption and damming of the molten thermoplastic insulation limits the spread of any underdeck fires by helping to prevent the molten thermoplastic from leaking through the metal deck and thus serving as fuel for the fire. A further advantage of the present invention is that the thermoplastic insulation layer serves as a heat sink, thereby helping to reduce the temperature of the roof. The absorbent also reduces heat channeling down the troughs of the metal deck, and reduces the air in the roof structure available for combustion. By reducing the ability of thermoplastic insulation to contribute to an underdeck fire, the present invention permits a contractor to place a layer of thermoplastic insulation material directly on the metal deck. This obviates the need for interposing a layer of gypsum board or fiber board between the insulation and metal deck, reduces the cost of the roof structure, and makes the use of thermoplastic insulation more cost competitive with other forms of roof insulation.

It is therefore an object of the present invention to provide a fire retardant for a roof structure system which, in a fire situation, reduces the likelihood of molten insulation material contributing to the spread of a fire by providing an absorbent to absorb the molten plastic insulation material.

These and other features and advantages of the invention will become apparent from the following detailed description, the accompanying drawings and the appended claims.

DETAILED DESCRIPTION OF THE PREFERRED EMBODIMENTS

Figure 1:
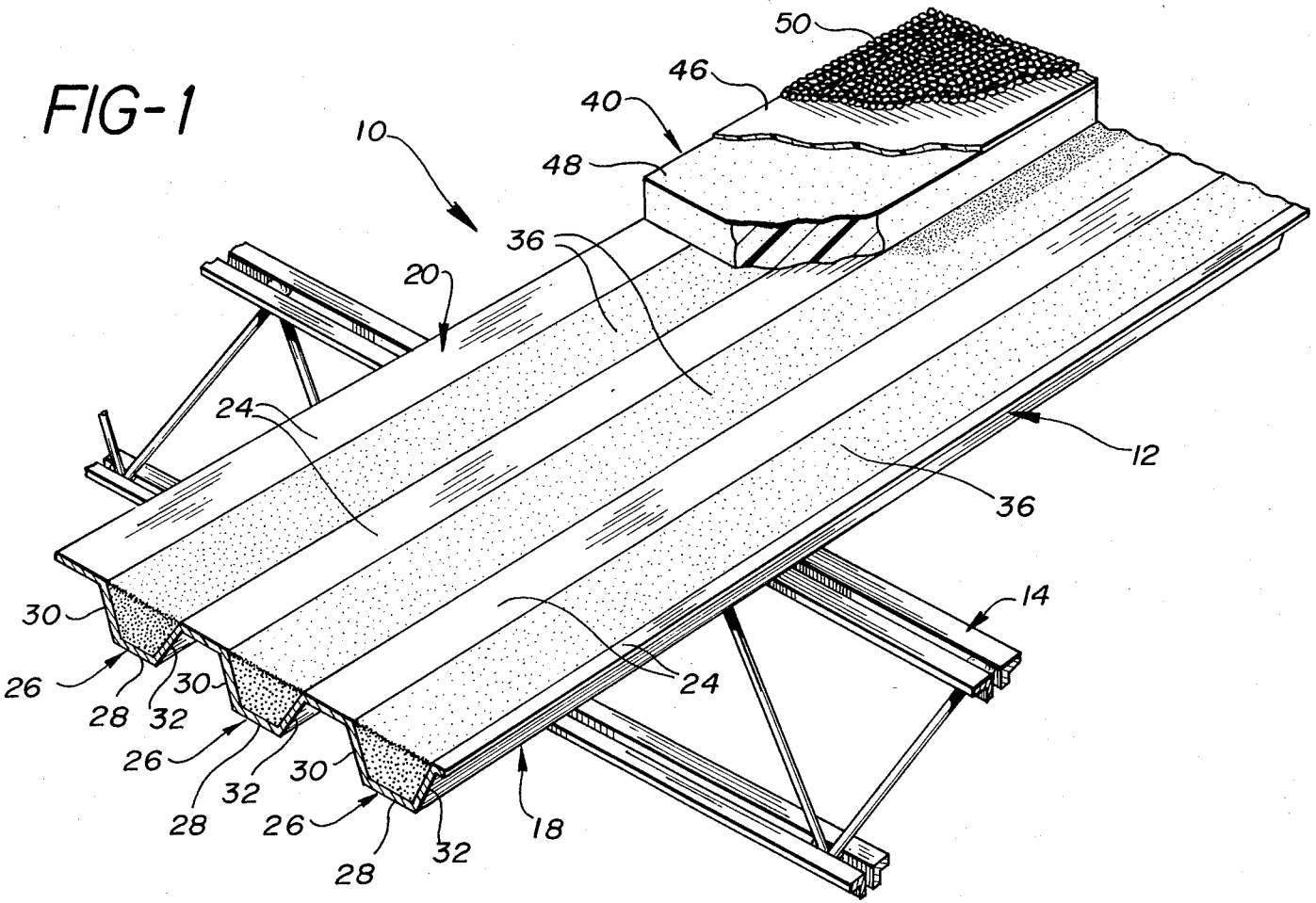
FIG. 1 is a perspective view, partly broken away, of the present invention.

A roof structure system 10 of the present invention is shown in FIG. 1 as including a fluted metal deck 12 supported on a superstructure member 14 of a building (not shown). The fluted metal deck 12 and superstructure member 14 are typical of decks and superstructures used in commercial buildings such as factories, shopping centers, warehouses and the like. The fluted metal deck 12 is preferably mounted to the superstructure member 14 by welding.

The fluted metal deck 12 includes a lower or bottom surface 18 and an upper or top surface 20. As viewed from top surface 20, the fluted metal deck 12 includes a series of parallel, longitudinally extending, generally planar crests 24. A series of longitudinally extending trapazoidal troughs 26 are disposed between the crests 24 and are generally parallel thereto. The troughs 26 include a generally planar bottom surface 28 and a pair of of angled sidewalls 30 and 32.

Strips 36 of non-flammable, absorbent material are placed in each of the troughs 26 and, in the embodiment of FIG. 1, extend along the entire length of each trough 26. Preferably, each strip 36 fills the trough up to the top of the sidewalls 30, 32 such that the cross-sectional area of each strip 36 is generally equal to the cross-sectional area of the trough 26 in which the strip 36 is placed.

A layer of metable, thermoplastic insulation material 40 overlays the metal deck 12. The underside surface of the insulation material 40 is preferably placed directly on the upper surface 20 of the metal deck 12 so that the insulation material 40 rests on the crests 24 and spans the troughs 26 of the metal deck 12. Although only a small section of the insulation material 40 is shown in the figures, the insulation material 40 will generally overlay the entire metal deck 12.

A layer of water impermeable material 46 may overlay the upper surface 48 of the insulation layer 40. The water impermeable material seals the roof to prevent the intrusion of moisture.

A layer of ballast material 50 (here shown as gravel) is preferably placed over the water impermeable layer 46. The ballast layer 50 provides additional weight on the roof to help prevent the components of the roof from becoming dislodged in heavy winds.

Figure 2:
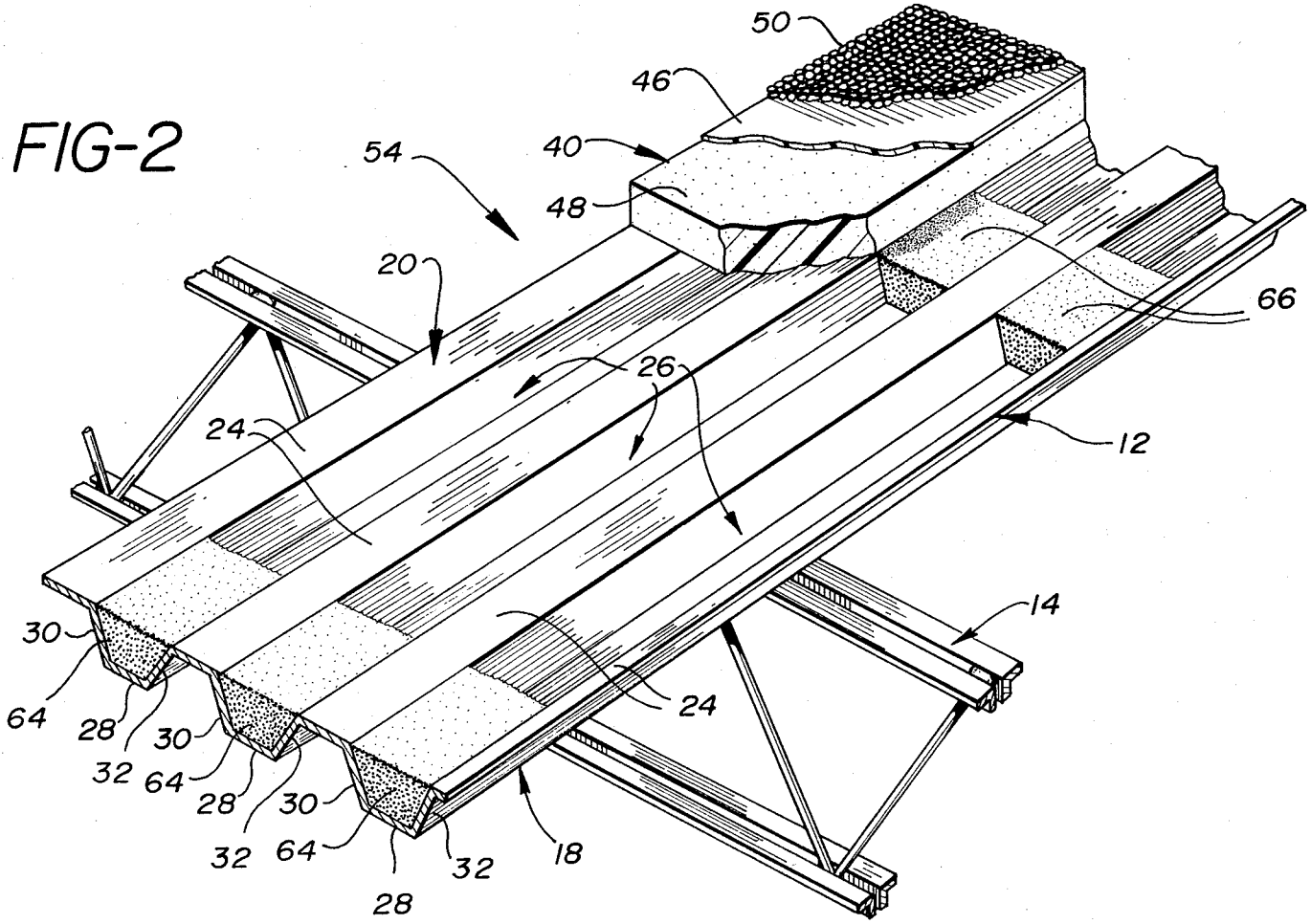
FIG. 2 is a perspective view, partly broken away, of an alternate embodiment of the present invention.

An alternate embodiment of the present invention is shown in FIG. 2. In the embodiment shown in FIG. 2, the deck 12, superstructure 14, insulation layer 40, water impermeable layer 46 and ballast layer 50 are similar to those shown in FIG. 1. FIG. 2, however, shows an alternate embodiment in terms of the absorbent strips.

The absorbent strips shown in FIG. 2 each comprise a pair of discrete, spatially separated strip segments 64 and 66. Each strip segment 64, 66 has a cross-sectional area generally equal to the cross-sectional area of the trough 26 in which it is placed and has a length of preferably between about 1 and 6 inches (2.54 and 15.24 cm) long and most preferably between about 3 and 6 inches (7.62 and 15.24 cm) long. The strip segments 64. 66 of each strip are preferably spaced apart approximately 2 to 10 feet (0.61 to 3.05 meters). The length of the strip segments 64, 66 should be greater than the width of the troughs 26 in which the segments 64, 66 are placed. The strip segments in adjacent troughs are aligned to form an array wherein strip segments 64 form a linear row extending generally perpendicular to the longitudinal extent of the troughs 26, and strip segments 66 form a linear row extending perpendicular to the longitudinal extent of troughs 26.

A wide variety of materials can be used for each of the components of the roof structure of the present invention.

The choice of material used in the fabrication of the metal deck 12 is determined by factors such as the strength, weight, and cost of the material, ease of fabrication, resistance to corrosion and flammability. Typically, metal decks 12 for commercial and industrial buildings are fabricated from either steel or aluminum. It will be appreciated that the metal deck 12 of a typical building will comprise a plurality of interfitted metal deck panels which are joined by riveting, welding or the like. Notwithstanding the care taken in joining the panels together, the seams at which the metal panels are joined are usually not leak-proof. Thus, the seams can provide a path through which molten insulation material can travel into the interior of a building during a fire. Additionally, the high temperatures experienced by the panels can cause the seams to come apart, thus increasing the flow of molten insulation material into the interior of a burning building.

Although the troughs 26 and crests 24 of the metal deck 12 shown in the figures have a generally trapazoidal cross-sectional shape, it will be appreciated that metal decks can be utilized having a wide variety of other cross-sectional shapes.

The ideal material from which to fabricate the absorbent strips 36 or strip segments 64, 66, is a non-combustible, relatively inexpensive, inert granular inorganic material, which can absorb hydrophobic materials such as molten thermoplastic insulation. Additionally, the material should be capable of being packed in the troughs 26 to have a relatively low permeability to molten thermoplastic materials so that the molten material will flow through the absorbent strip 36, and strip segments 64, 66 (if at all) at a relatively slow rate.

Examples of materials which can perform well as the absorbent strip material include sand, gypsum, fly ash, vermiculite, glass fibers, expandable shale, expandable clay, iron or slag, firestop caulking, crushed glass, cement powder, crushed shells, pea gravel, epsom salts and crushed rocks.

Most preferred of the materials listed above are expandable shale and expandable clay. Expandable clay and shale are most preferred because of their ability to absorb molten thermoplastic material and their ability to expand to occupy available space in the trough.

The absorbent strips 36 and strip segments 64, 66 generally do not include backing materials or binders. Rather, the absorbent material is poured directly into the trough 29. Due to the fact that most of roof structures with which the present invention is utilized are flat, or sloped only slightly, a loose packed absorbent will generally maintain its position in the trough without the positional shifting which might occur in roofs having a greater pitch.

The absorbent material should be placed in the troughs 26 so that the top of the absorbent material is generally co-planar with the crests 24. By making the absorbent material flush with the crests 24, gases formed by vaporized insulation material are prevented from flowing in the troughs by passing between the absorbent strip 36 and the underside surface of the insulation layer 40. However, the crest 24, should be free of absorbent material to provide a smooth, planar surface upon which the thermoplastic insulation material 40 can rest.

It is believed that the best method for applying the absorbent strips 36 and strip segments 64, 66 is by the use of a device similar to a gravel spreader having a high enough flow rate to fill the troughs 26 with absorbent material.

In order to form the more block-like strip segments 64, 66 shown in the embodiment of FIG. 2 the same absorbent materials as those used for the embodiment of FIG. 1 can be used. The length of the strip segments 64, 66, should be great enough to ensure that the apex of the segment will remain generally co-planar with the crest 24 after the absorbent materials in the strip segments 64, 66 have settled. Thus, although the segments 64, 66 are illustrated in FIG. 2 as being block shaped, the segments 64, 66 can have a truncated, pyramid-like shape.

As shown in FIG. 2, the strip segments 64, 66 are arranged in rows extending generally perpendicular to the longitudinal extent of the troughs 26. Through this arrangement, the segments help to compartmentalize the roof and thus help to contain the spread of the fire between various compartments. Although the segments 64, 66 can be placed at various positions on the deck 12, they are preferably placed at least in the areas of the metal deck above the seams adjoining adjacent panels of the deck.

The spacing between rows of segments 64, 66 is largely dependent on the size of the panels used for the metal deck 12. For example, if an eight foot (2.44 meter) panel (as measured in a direction parallel to the longitudinal extent of the troughs 26) is used, the spacing between adjacent rows of segments 64, 66 would be no more than eight feet apart so that the segments 64, 66 could be placed above the seams joining adjacent panels. Preferably, a row of strip segments would also be placed intermediate the rows of segments over the seams, thus yielding a spacing of four feet (1.22 meters) between adjacent rows.

The amount of absorbent material used on a particular roof is largely dependent on the thickness of the insulation. A relatively greater amount of absorbent material is used when the insulative layer 40 is relatively thick (e.g. 8 inches); and a relatively lesser amount of absorbent material is used when the insulative layer is relatively thin (e.g. 2 inches). In the embodiment shown in FIG. 2, the amount of absorbent material used can be varied by varying either the length of the strip segments 64, 66 or the spacing between segment rows.

A wide variety of thermoplastic foams can be used for insulative layer 40. Generally, the considerations used in determining which type of foam to use are based on such as factors as insulative capacity of a particular foam, weight, cost, melting point, and availability. With regard to weight, the plastic foam used in the present invention should have a density of between about 0.25 and 4 lbs/ft$^3$. Examples of such thermoplastic foams include extruded polystyrene foams, molded bead polystyrene foams, polyurethane foam, polyvinyl chloride foam, and some thermoplastic polyisocyanate foams. Typically, the insulation material 40 is formed in sheet-like blocks having a thickness of generally between about 1 and 8 inches, and preferably about 3 inches thick, a width of either 2 feet (0.61 meters) or 4 feet (1.22 meters) and a length of about 8 feet (2.44 meters). The panels which comprise the insulative layer 40 can be clipped together or attached to the metal deck 12 to help the panels maintain their proper positioning.

Several water impermeable materials can be used for the water impermeable layer 46. Although asphalt compounds have been used as water impermeable layers on prior art roofs, they are not preferred due to their combustibility. Preferably, the water impermeable layer comprises a sheet membrane which may be made of either a thermosetting plastic or a thermoplastic material. Examples of such materials for use as sheet membranes include ethylene propylene diene monomer (EPDM), polyvinyl chloride (PVC), chlorinated polyethylene (CPE), chlorosulfonated polyethylene (CSPE), polyisobutylene (PIB), and chlorinated polyvinyl acrylonitrile (CPA). Typically, the sheet membrane of water impermeable material is dispensed on rolls generally having a width of about 3 to 10 feet (0.914 and 3.05 meters) and a thickness of between about 0.030 and 0.060 inches (0.76 and 1.52 mm).

The ballast layer 50 preferably comprises a gravel, such as ASTM No. 4 stone having an average diameter of between 1.25 and 1.5 inches (3.175 and 3.81 cm). The No. 4 stone is placed on top of the water impermeable layer 46 to a depth of approximately 1½ to 2 inches (3.175 to 4.08 cm) to achieve a ballast weight of about 10 lb/ft$^2$. The ballast 50 protects the underlying roof components from ultraviolet radiation and provides resistance to wind and buoyancy. Therefore, the amount of ballast 50 placed on the roof should be sufficient to achieve the above objectives without placing undue stress on the structural components of the roof. As an alternative to gravel, a sand and cement mixture can be used as the ballast layer. Such a sand and cement layer would typically have a thickness of between about 0.25 and 4 inches (1.91 and 8.16 cm).

The fire retardant of the present invention helps to prevent the spread of fire in an underdeck fire situation in the following manner. The heat from a fire burning in the interior of the building causes the metal deck 12 to become heated. The metal deck 12 conducts the heat to the thermoplastic insulation layer 40. If enough heat is applied to the thermoplastic insulation layer, the thermoplastic insulation layer 40 will eventually begin to melt from the bottom up. The insulation layer 40 is likely to melt from the bottom up because the bottom surface of the insulation layer 40 is the surface which is in contact with the crests 24 of the heated metal deck 12. As the insulation layer 40 begins its melting process, three events will occur at about the same time.

The first event involves the formation of molten and vaporous thermoplastic material along the bottom surface of the thermal insulation layer 40. This molten or vaporous material will tend to flow downwardly into troughs 26.

In the embodiment shown in FIG. 1, this molten and vaporous material will be absorbed by the absorbent strips 36 as it flows into the troughs 26, thus retarding the flow of the molten vaporous material along the troughs 26. By retarding the flow of the vaporous and molten material, the vaporous and molten thermoplastic material is less likely to be able to find its way to a seam, joint, or crack in the deck 12 through which it can pass into the interior of the building.

In the embodiment shown in FIG. 2, the molten or vaporous material will flow into the trough 26, and along the trough 26 to a point wherein it encounters one of the strip segments 64, 66. The molten material will be both absorbed and dammed by the segments 64, 66, thus retaining the material within the compartment formed between adjacent segments 64, 66 and retarding the flow of the material past the segments 64, 66.

The second event which occurs is that as the thermoplastic insulation material 40 melts, is that it absorbs heat from the metal deck 12. By absorbing heat from the metal deck 12, the insulation material 40 serves as a heat sink and keeps the metal deck 12 relatively cooler.

The third event which occurs during the melting of the thermoplastic insulation material 40, is that the foam cells of the thermoplastic insulation material 40 tend to collapse as the thermoplastic insulation material 40 melts. This collapse of the cells permits the gravel of the ballast layer 50 to penetrate into the thermoplastic insulation material 40. This penetration of the gravel into the thermoplastic insulation layer 40 causes the gravel to form a firewall-like enclosure around the roof, thereby impeding the flow of oxygen into the interior of the building.

Thus, it will be appreciated that the instant invention provides a means for utilizing thermoplastic insulation to form a relatively fire-resistant roof structure.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A fire retardant roof structure comprise a deck with a plurality of alternating troughs and crests, a meltable plastic insulation layer overlying said deck and a fire retardant comprising a plurality of non-flammable absorbent strips, said absorbent strips being comprised of a loose packed, granular material disposed in said troughs for retarding the flow of liquid and vaporous insulation material during a fire by absorbing the liquid and vaporous insulation material flow in the trough.

2. The fire retardant of claim 1 wherein said non-flammable absorbent strips have a cross-sectional area generally equal to the cross-sectional area of the troughs in which said strips are placed.

3. The fire retardant of claim 1 wherein the length of each said non-flammable absorbent strip is generally equal to the length of the troughs.

4. The fire retardant of claim 1 wherein each said non-flammable absorbent strip comprises a plurality of strip segments disposed in a spaced relation in said trough, and wherein strip segments in adjacent troughs are arrayed in generally linear rows.

5. A roof structure system comprising:

a deck member having an upper surface including at least one trough portion and at least two crest portions, a thermoplastic insulation member disposed on said crest portions and spanning said trough portion, a non-flammable absorbent strip of a loose packed, granular inorganic absorbent material disposed in said trough portion for retarding the flow of molten insulation in said trough portion during a fire, a water impermeable membrane layer disposed in an overlying relation to said thermoplastic insulation member, and ballast material disposed in an overlying relation to said water impermeable membrane.

6. The roof structure of claim 5 wherein said thermoplastic insulation has a density of between about 0.25 and 4 pounds per cubic foot.

7. The roof structure of claim 6 wherein said thermoplastic insulation member includes a lower surface which rests directly on said crest portions.

8. The roof structure of claim 6 wherein said thermoplastic insulation member is comprised of a material selected from the group consisting of polystyrene foams, polyurethane foams, polyvinyl chloride foams and thermoplastic polyisocyanate foams.

9. The roof structure of claim 5 wherein said water impermeable membrane is comprised of a material selected from the group consisting of ethylene propylene diene monomer, polyvinyl chloride, chlorinated polyethylene, chlorosulfonated polyethylene, polyisobutylene, and chlorinated polyvinyl acrylonitrile

10. The roof structure of claim 5 wherein said non-flammable absorbent strip is comprised of a material selected from the group consisting of sand, gypsum, fly ash, vermiculite, glass fibers, crushed glass, expandable shale, expandable clay, iron ore slag, firestop caulking, cement powder, crushed shells, pea gravel, epsom salts and crushed rocks.

11. The roof structure of claim 10 wherein said non-flammable absorbent strip has a cross-sectional area generally equal to the cross-sectional area of the trough portion.

12. The roof structure of claim 11 wherein said absorbant strip comprises a plurality of strip segments disposed in a spaced relation along said trough portion.

13. A method of fabricating a roof system comprising the steps of:

providing a deck member having crest portions and trough portions, placing a non-flammable absorbent strip of loose packed, granular inorganic material in said trough portions, placing a thermoplastic insulation member on said crest portions in an overlying relation to said trough portions, placing a water impermeable membrane layer in an overlying relation to said thermoplastic insulation member.

* * * * *